US011090647B2

(12) United States Patent
Sams

(10) Patent No.: US 11,090,647 B2
(45) Date of Patent: Aug. 17, 2021

(54) DOUBLE BOTTOM TEST TUBE KIT AND METHOD THEREFORE

(71) Applicant: U.S. ENVIRONMENTAL PROTECTION AGENCY, Washington, DC (US)

(72) Inventor: Elizabeth Ann Sams, Graham, NC (US)

(73) Assignee: U.S. ENVIRONMENTAL PROTECTION AGENCY, Washington, DC (US)

( * ) Notice: Subject to any disclaimer, the term of this patent is extended or adjusted under 35 U.S.C. 154(b) by 209 days.

(21) Appl. No.: 15/880,190

(22) Filed: Jan. 25, 2018

(65) Prior Publication Data

US 2018/0311662 A1 Nov. 1, 2018

Related U.S. Application Data

(60) Provisional application No. 62/602,566, filed on Apr. 28, 2017.

(51) Int. Cl.
*B01L 3/00* (2006.01)
*B01L 1/00* (2006.01)

(52) U.S. Cl.
CPC ..... *B01L 3/5021* (2013.01); *B01L 1/50* (2013.01); *B01L 3/50* (2013.01); *B01L 3/5023* (2013.01); *B01L 3/5082* (2013.01); *B01L 3/5453* (2013.01); *B01L 3/561* (2013.01); *B01L 2200/023* (2013.01); *B01L 2200/10* (2013.01); *B01L 2200/141* (2013.01); *B01L 2300/042* (2013.01); *B01L 2300/046* (2013.01); *B01L 2300/0609* (2013.01); *B01L 2300/069* (2013.01); *B01L 2300/0832* (2013.01); *B01L 2300/0867* (2013.01); *B01L 2400/0409* (2013.01)

(58) Field of Classification Search
CPC ..... B01L 3/5021; B01L 3/561; B01L 3/5453; B01L 3/5023; B01L 1/50; B01L 3/50; B01L 2300/0867; B01L 2200/10; B01L 2200/141; B01L 2300/0832; B01L 2300/069; B01L 2300/046; B01L 2300/042; B01L 2200/023; B01L 2400/0409; B01L 2300/0609; B01L 3/5082
See application file for complete search history.

(56) References Cited

U.S. PATENT DOCUMENTS 3,586,380 A * 6/1971 Alibeckoff ..... A61F 13/38 300/21
3,640,268 A * 2/1972 Davis ..... B01L 3/5029 600/572
3,733,179 A * 5/1973 Guehler ..... G01N 21/78 436/71
5,501,841 A * 3/1996 Lee ..... B01L 3/502 422/506
5,830,154 A * 11/1998 Goldstein ..... A61B 10/0051 600/572

(Continued)

*Primary Examiner* — Benjamin R Whatley
*Assistant Examiner* — Curtis A Thompson
(74) *Attorney, Agent, or Firm* — Weiss & Moy, P.C.; Jeffrey D. Moy

(57) ABSTRACT

A double bottom test tube has a first tubular section having an open end and a rounded closed end. A second tubular section has an open end and a rounded closed end. The open end of the first tubular section is couplable to the open end of the second tubular section.

8 Claims, 4 Drawing Sheets

(56) References Cited

U.S. PATENT DOCUMENTS

| | | | | |
|---|---|---|---|---|
| 6,599,754 | B2 * | 7/2003 | Miller | B01J 19/0046 436/177 |
| 8,728,414 | B2 * | 5/2014 | Beach | B01L 3/50825 422/550 |
| 9,027,420 | B1 * | 5/2015 | Ward | G01N 1/02 73/864.71 |
| 2005/0023182 | A1 * | 2/2005 | Shah | B01L 3/5021 206/570 |
| 2010/0111773 | A1 * | 5/2010 | Pantelidis | G01N 21/07 422/400 |
| 2010/0307967 | A1 * | 12/2010 | Clark | B01D 61/08 210/291 |
| 2011/0004122 | A1 * | 1/2011 | Sangha | A61B 10/0045 600/572 |
| 2012/0048002 | A1 * | 3/2012 | Mallet | B01L 3/5635 73/61.43 |
| 2014/0051178 | A1 * | 2/2014 | Niggel | B01L 3/5029 436/164 |
| 2017/0036205 | A1 * | 2/2017 | Bishop | A61B 10/0051 |
| 2018/0272330 | A1 * | 9/2018 | Lee | B01L 3/502 |
| 2020/0009052 | A1 * | 1/2020 | Guryev | B01D 63/087 |

* cited by examiner

DOUBLE BOTTOM TEST TUBE KIT AND METHOD THEREFORE

RELATED APPLICATION

This patent application is related to U.S. Provisional Application No. 62/602,566 filed Apr. 28, 2017, entitled "Double-Bottom Test Tube Kit" in the name of the Elizabeth Ann Sams, which is incorporated herein by reference in its entirety. The present patent application claims the benefit under 35 U.S.C. § 119(e).

TECHNICAL FIELD

The present application relates generally to the technical field of test tubes, and more specifically, to the technical field of a double bottom test tube having a pair of rounded end sections which connect together, the double bottom test tube reduces the possibility of contamination during the process of centrifugation of a specimen.

BACKGROUND

Test tubes are generally tubular containers of varying lengths made out of glass or a clear plastic material. Test tubes usually have an open top and a rounded closed bottom. Test tubes are generally used to hold and/or culture different specimens for analysis. A stopper, flat top seal, or similar device may be used to seal the open top of the test tube to prevent the escape of contents placed therein.

When collecting biological and/or environmental specimens to be placed within the test tube, a collection device may be used. The collection device may be a cellulose collection device which is able to absorb/collect the specimen. Most cellulose collection devices are formed of a cellulose sponge having a non-porous stick extending out of one end. When a sample has been collected, the collection device is placed in the test tube with the collection portion, cellulose sponge in the above example, placed in rounded closed bottom section of the test tube. The test tube may then be sealed with the stopper or flat top seal. Prior to centrifuging the collected specimen, one must remove the stopper or flat top seal and reposition the collection device so that the collection portion, is positioned at the top open end of the test tube. This may allow the specimen to be centrifuged into the rounded closed bottom section of the test tube and prevents the collection portion from reabsorbing the specimen after centrifuging. The repositioning of the collection device within the test tube is a potential source of contamination and may cause unnecessary work in the extraction of the specimen. It further causes additional personnel time burden on processing the specimen.

Therefore, it would be desirable to provide a system and method that overcomes the above. The system and method would allow one to centrifuge specimens without the need to reposition the collection device within the test tube.

SUMMARY

In accordance with one embodiment, a double bottom test tube is disclosed. The device has a first tubular section having an open end and a rounded closed end and a second tubular section having an open end and a rounded closed end. The open end of the first tubular section is couplable to the open end of the second tubular section.

In accordance with one embodiment, a double bottom test tube is disclosed. The double bottom test tube device has a first tubular section having an open end and a rounded closed end and a second tubular section having an open end and a rounded closed end. A connector secures the open end of the first tubular section to the open end of the second tubular section. A collection device is sized to fit within the double bottom test tube.

In accordance with one embodiment, a method of using a double bottom test tube is disclosed. The method comprises: collecting a specimen on an absorbent section of a collection device; inserting the collection device into the double bottom test tube, the double bottom test tube having a first tubular section having an open end and a rounded closed end and a second tubular section having an open end and a rounded closed end, the absorbent section inserted into one of the rounded closed end of the first section or the rounded closed end of the second section; securing the open end of the first section to the open end of the second section; and centrifuging the double ended test tube wherein the centrifuged sample collects in an opposite end of the double ended test tube holding the absorbent section.

BRIEF DESCRIPTION OF THE DRAWINGS

The present application is further detailed with respect to the following drawings. These figures are not intended to limit the scope of the present application but rather illustrate certain attributes thereof. The same reference numbers will be used throughout the drawings to refer to the same or like parts.

DESCRIPTION OF THE APPLICATION

Figure 1:
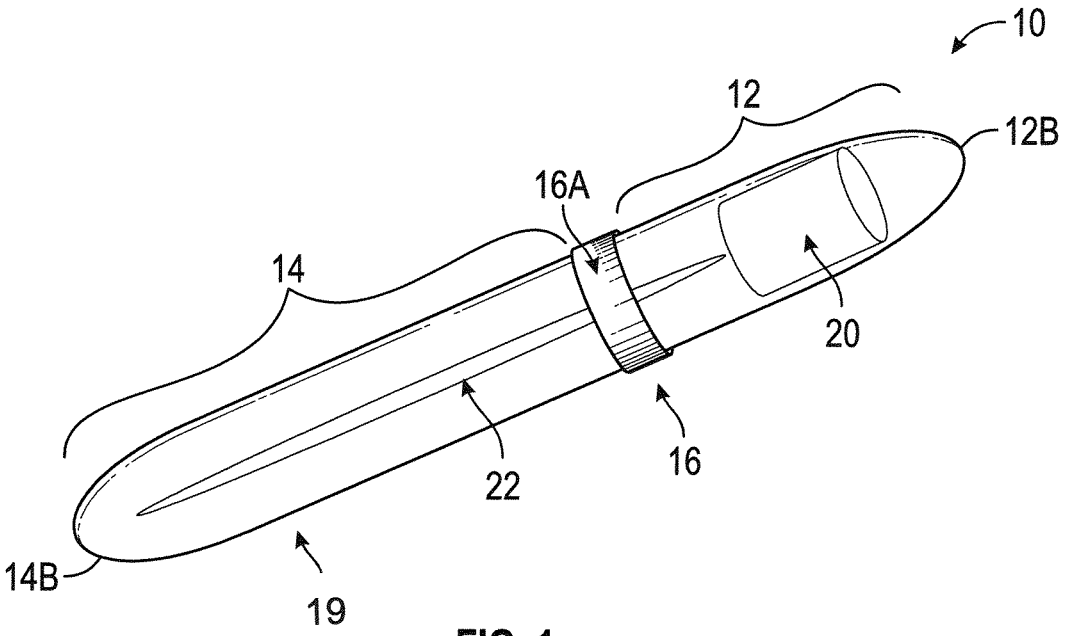
FIG. 1 is a perspective view of an exemplary embodiment of a double bottom test tube with a collection device inserted in a first position in accordance with one embodiment of the present invention.

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions an sequences can be accomplished by different embodiments that are also intended to be encompassed within the spirit and scope of this disclosure.

Embodiments of the exemplary system and method disclose a double bottom test tube having a pair of rounded end sections which connect together. The double bottom test tube reduces the possibility of contamination during the process of centrifugation of a specimen as the double bottom test tube does not require the repositioning of the collection device within the double bottom test tube as in prior art test tubes.

Referring to FIGS. 1-5, a double bottom test tube 10 (hereinafter test tube 10) may be disclosed. The test tube 10 may be comprised of a first section 12 and a second section 14. The first section 12 may be a tubular container of varying lengths having an open end 12A and a rounded closed end 12B. The second section 14 may be a tubular container of varying lengths having an open end 14A and a rounded closed end 14B. In the embodiment shown in FIGS. 1-4, the first section 12 may be shorter in length than the second section 14. However, this is shown as an example and should not be seen in a limiting manner. As may be seen in FIG. 5, the first section 12 and the second section 14 may be approximately equal in length. The first section 12 and the second section 14 may be formed of glass, a clear plastic or similar materials. In accordance with one embodiment, the material used to form the first section 12 and the second section 14 should be strong enough to withstand the force exerted by a centrifuge. The material used to form the first section 12 and the second section 14 may also be strong enough to withstand cryogenic conditions.

The open end 12A of the first section 12 may be coupled to the open end 14A of the second section 14 to form a seal that prevents the contents stored within the test tube 10 from leaking out. Connections 15 such as male/female connections, screw type connections, or similar connections may be formed on the open end 12A of the first section 12 and the open end 14A of the second section 14 to couple the open end 12A of the first section 12 to the open end of 14A of the second section 14. In accordance with one embodiment, a connector 16 may be used to secure the first section 12 to the second section 14. The connector 16 may be used to secure the open end 12A of the first section 12 to the open end 14A of the second section 14 and form a seal that prevent the contents stored within the test tube 10 from leaking out. The connector 16 may be removable. In the embodiment shown in FIG. 3, the connector 16 may first be attached to the open end 12A of the first section 12. The open end 14A of the second section 14 may then be attached to the connector 16 forming the test tube 10. However, the connector 16 may be attached to the open end 14A of the second section 14 with the open end 12A of the first section 12 being attached to the connector 16 without departing from the spirit and scope of the present invention.

In accordance with one embodiment, the connector 16 may be a flange seal 16A. The flange seal 16A may have a pair of channels 18 which runs along an interior perimeter of the flange seal 16A. One of the channels 18 may mate with a lip 12C formed around an outer perimeter of the open end 12A of the first section 14 so that the lip 12C fits within one of the channels 18. Another of the channels 18 may mate with a lip 14C formed around an outer perimeter of the open end 14A of the second section 14 so that the lip 14C fits within one of the channels 18. The lips 12C and 14C may form a seal with the flange seal 16A that prevents the contents of the test tube 10 from leaking out. The above is given as an example and should not be seen in a limiting manner. The connector 16 may take on other embodiments without departing from the spirit and scope of the present invention. For example, the connector 16 may be a screw type connector, a male/female connector, or the like.

The test tube 10 may have a collection device 19. The collection device 19 may have an absorbent section 20. The absorbent section 20 may be used to absorb/collect a specimen. The absorbent section 20 may be a non-reactive sponge, cellulose fiber material, or similar device. A handle 22 may extend from the absorbent section 20. In accordance with one embodiment, the handle 22 may be a non-porous, non-absorbent stick which extends out of one end of the absorbent section 20. The handle 22 must not be able to absorb fluids or components of fluids from the sample.

The test tube 10 may have a cap 24. The cap 24 may be used to place over and cover the open end 12A of the first section 12 or the open end 14A of the second section 14. The cap 24 may be a rubber stopper, a flat top cap, or similar device. In the embodiment shown in FIG. 4, the cap 24 is a flat top cap 24A. The flat top cap 24A may be configured to snap fit over the open end 12A of the first section 12 or the open end 14A of the second section 14. In the embodiment shown in FIG. 4, the flat top cap 24A fits over the open end 12A of the first section 12. The cap 24 may be used to prevent the specimen 26 from leaking out after the specimen 26 has been centrifuged. In accordance with one embodiment, the cap 24 may be formed of a material to withstand cryogenic and/or centrifugation conditions. For example, a cryogenic polypropylene or similar type of material may be used.

Figure 2:
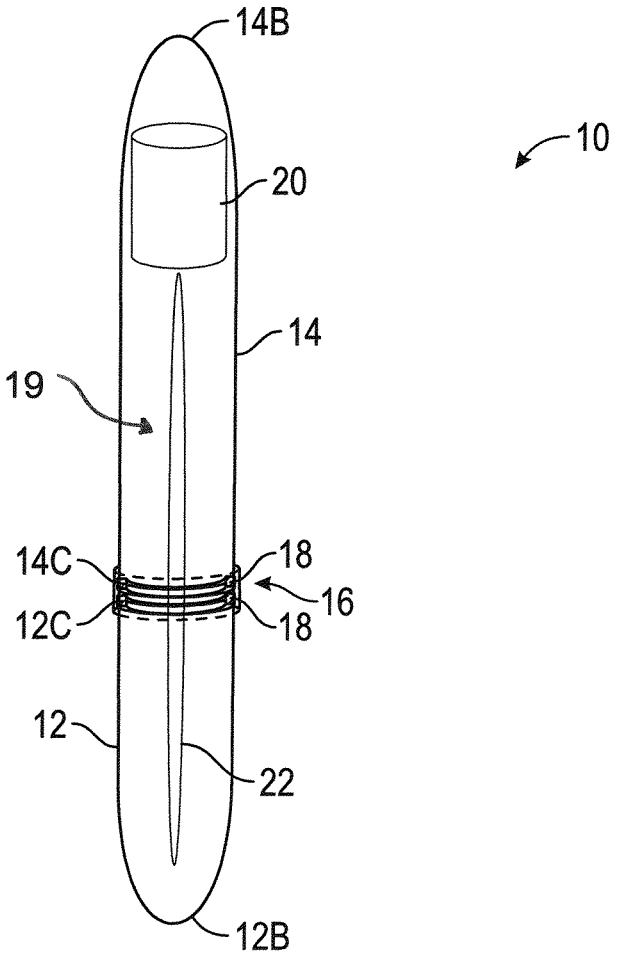
FIG. 2 is a front view of the double bottom test tube of FIG. 1 with the collection device inserted in a second position in accordance with one embodiment of the present invention.
Figure 3:
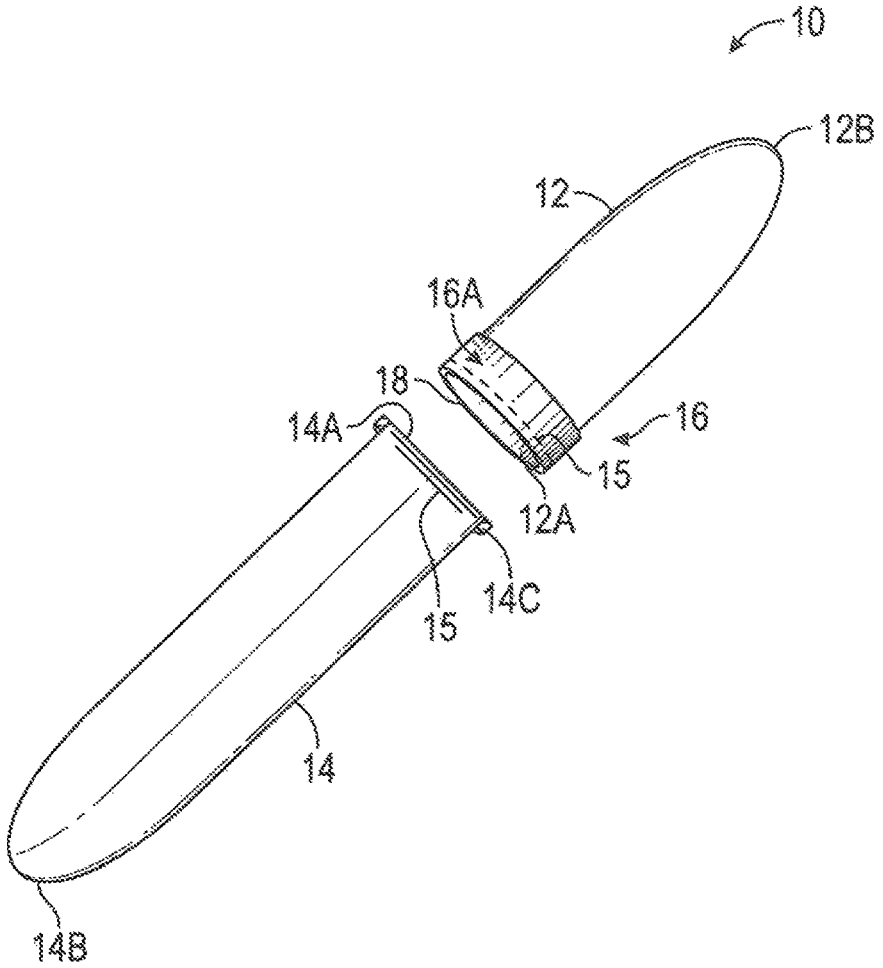
FIG. 3 is an exploded view of the double bottom test tube of FIGS. 1-2 with the collection device removed in accordance with one embodiment of the present invention.
Figure 4:
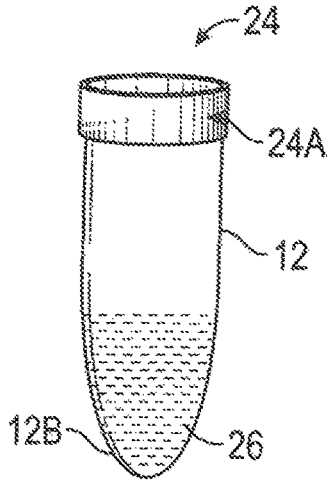
FIG. 4 is front view of one section of the double bottom test tube of FIGS. 1-2 holding a centrifuged specimen in accordance with one embodiment of the present invention.
Figure 5:
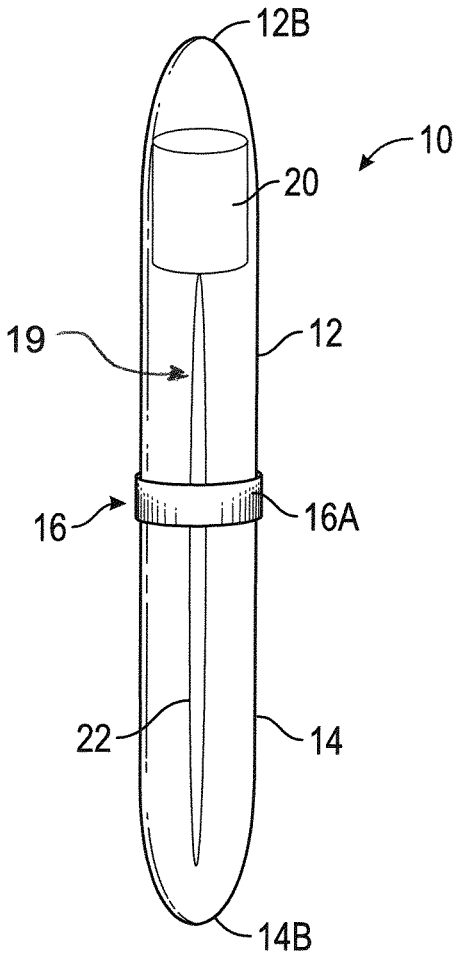
FIG. 5 is a front view of an exemplary embodiment of a double bottom test tube with a collection device inserted therein in accordance with one embodiment of the present invention.
Figure 6:
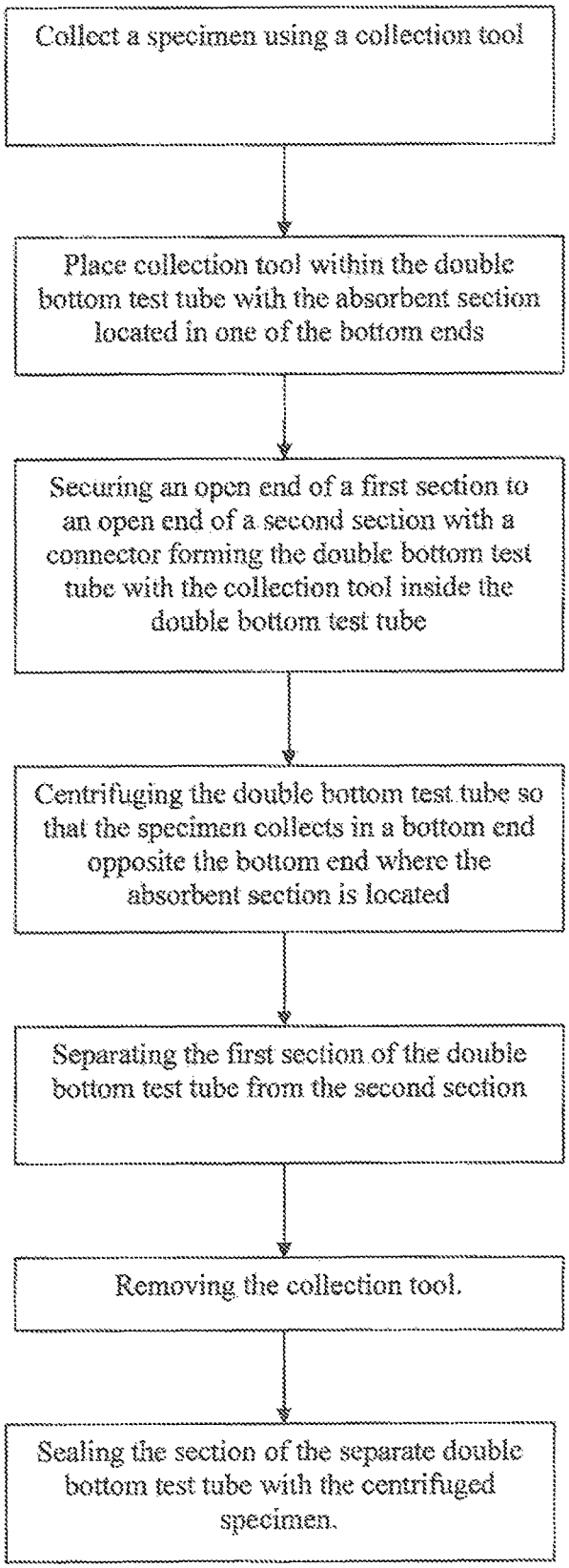
FIG. 6 is a flowchart showing a method of using the double bottom test tube in accordance with one embodiment of the present invention.

Referring to FIGS. 1-6, when a specimen has been collected with the collection device 19, the collection device 19 may be placed within the test tube 10. The collection device 19 may be placed in either the first section 12 or the second section 14. The collection device 18 may be placed in either the first section 12 or the second section 14 so that the absorbent section 20 is positioned in either the rounded closed end 12B of the first section 12 as shown in FIG. 1 or the rounded closed end 14B of the second section 14 as shown in FIG. 2. Once the collection device 19 is placed within either the round closed end 12B of the first section 12 or the round closed end second section 14B of the second section 14, the open end 12A of the first section 12 is secured to the open end 14A of the second section 14 with the connector 16.

Once the first section 12 is secured to the second section 14, the test tube 10 may be centrifuged. The test tube 10 should be positioned within a centrifuge so that the end containing the absorbent section 20 is positioned upright allowing the specimen to collect at the opposing end where the absorbent section 20 is not present. Thus, in the embodiment shown in FIG. 1, the round closed end second section 14B of the second section 14 is inserted into the centrifuge and used to collect the centrifuged specimen. In the embodiment shown in FIG. 2, the round closed end 12B of the first section 12 is inserted into the centrifuge and used to collect the centrifuged specimen.

Once the specimen is centrifuged, the first section 12 is separated from the second section 14. In accordance with one embodiment, the connector 16 may be removed. After separating the first section 12 from the second section 14, the collection device 19 may be removed from the test tube 10. The cap 24 may then be placed over the open end 12A of the first section 12 if the first section 12 is used to collect the centrifuged sample or over the open end 14A of the second section 14 if the second section 14 is used to collect the configured sample. Alternatively, instead of using the cap 24, the second section 14 may be reattached to the first section 12 to store and prevent contamination of the centrifuge specimen.

The foregoing description is illustrative of particular embodiments of the application, but is not meant to be a limitation upon the practice thereof. The following claims, including all equivalents thereof, are intended to define the scope of the application.

What is claimed is:

1. A double bottom test tube comprising:

a first tubular section having an open end and a rounded closed end, a first tubular section lip member formed around an outer perimeter of the open end of the first tubular section;

a second tubular section having an open end and a rounded closed end, a second tubular section lip member formed around an outer perimeter of the open end of the second tubular section;

a connector for securing the open end of the first tubular section to the open end of the second tubular section and to allow contents of a sample to flow through the open end of the first tubular section through the open end of the second tubular section and into the rounded closed end of the second tubular section or through the open end of the second tubular section through the open end of the first tubular section and into the rounded closed end of the first tubular section, wherein the connector is removable from the first tubular section and the second tubular section, the connector is a flange seal, a pair of channels formed around an interior perimeter of the flange seal, wherein each of the pair of channels is configured to hold one of the first tubular section lip member or the second tubular section lip member while allowing the contents of the sample to flow through the open end of the first tubular section and through the open end of the second tubular section to the rounded closed end of the second tubular section or through the open end of the second tubular section through the open end of the first tubular section to the rounded closed end of the first tubular section; and a collection device, wherein the collection device comprises:

an absorbent section; and a handle extending out of the absorbent section, the handle extending through the open end of the first tubular section and the open end of the second tubular section;

wherein when the absorbent section is positioned in the rounded closed end of the first tubular section, the handle extends through the open end of the first tubular section and the open end of the second tubular section and rests in the rounded closed end of the second tubular section, the rounded closed end of the second tubular section is configured as a collection end during centrifugation of the sample and when the absorbent section is positioned in the rounded closed end of the second tubular section, the handle extends through the open end of the second tubular section and the open end of the first tubular section and rests in the rounded closed end of the first tubular section, the rounded closed end of the first tubular section is configured as the collection end during centrifugation of the sample.

2. The double bottom test tube of claim 1, comprising a cap coupled to either the open end of the first tubular section or the open end of the second tubular section when the first section is uncoupled from the second section.

3. The double bottom test tube of claim 1, wherein the first tubular section and the second tubular section are symmetrical in size and shape.

4. The double bottom test tube of claim 1, wherein, the absorbent section is a sponge sized to fit within one of the first tubular section or the second tubular section; and the handle is non-porous and non-absorbent and extends out of the sponge.

5. The double bottom test tube of claim 2, wherein the cap is a flat top cap.

6. A double bottom test tube comprising:

a first tubular section having an open end and a rounded closed end, a first tubular section lip member formed around an outer perimeter edge of the open end of the first tubular section;

a second tubular section having an open end and a rounded closed end, a second tubular section lip member formed around an outer perimeter edge of the open end of the second tubular section;

a connector for securing the open end of the first tubular section to the open end of the second tubular section to allow contents of a sample to flow from the rounded closed end of the first tubular section through the open end of the first tubular section and the open end of the second tubular section and into the rounded closed end of the second tubular section or from the rounded closed end of the second tubular section through the open end of the second tubular section and the open end of the first tubular section and into the rounded closed end of the first tubular section, wherein the connector is removable from the first tubular section and the second tubular section, the connector is a flange seal, a pair of channels formed around an interior perimeter of the flange seal, wherein each of the pair of channels is configured to hold one of the first tubular section lip member or the second tubular section lip member while allowing the contents of the sample to flow through the open end of the first tubular section and through the open end of the second tubular section to the rounded closed end of the second tubular section section to the rounded closed end of the first tubular section;

a collection device sized to fit within the double bottom test tube and extending through the open end of the first tubular section and the open end of the second tubular section, wherein the collection device comprises:

an absorbent section; and a handle extending out of the absorbent section, the handle extending through the open end of the first tubular section and the open end of the second tubular section;

wherein when the absorbent section is positioned in the rounded closed end of the first tubular section, the handle extends through the open end of the first tubular section and the open end of the second tubular section and rests in the rounded closed end of the second tubular section, the rounded closed end of the second tubular section is configured as a collection end during centrifugation of the sample and when the absorbent section is positioned in the rounded closed end of the second tubular section, the handle extends through the open end of the second tubular section and the open end of the first tubular section and rests in the rounded closed end of the first tubular section, the rounded closed end of the first tubular section is configured as the collection end during centrifugation of the sample; and a cap coupled to the open end of the first tubular section when the first tubular section is uncoupled from the second tubular section and the first tubular section is configured as the collection end or the cap coupled to the open end of the second tubular section when the second tubular section is uncoupled from the first tubular section and the second tubular section is configured as the collection end.

7. The double bottom test tube of claim 6, wherein the first tubular section and the second tubular section are symmetrical in size and shape.

8. The double bottom test tube of claim 6, wherein, the absorbent section s a sponge sized to fit within one of the first section or the second section; and the handle is non-porous and non-absorbent and extends out of the sponge.

* * * * *